United States Patent [19]

Humphreys

[11] Patent Number: 4,524,705

[45] Date of Patent: Jun. 25, 1985

[54] SPADE GUSSET SEAMING APPARATUS

[75] Inventor: John C. Humphreys, Hinckley, England

[73] Assignee: H. Flude & Company (Hinckley) Limited, Leicestershire, England

[21] Appl. No.: 359,093

[22] Filed: Mar. 17, 1982

[30] Foreign Application Priority Data

Mar. 18, 1981 [GB] United Kingdom ..... 8108526

[51] Int. Cl.[3] ..... D05B 21/00

[52] U.S. Cl. ..... 112/121.15; 112/262.3

[58] Field of Search ..... 112/121.15, 121.11, 112/121.12, 121.29, 262.3

[56] References Cited

U.S. PATENT DOCUMENTS 4,220,104 9/1980 Humphreys ..... 112/121.15 X 4,321,881 3/1982 Humphreys ..... 112/121.15

FOREIGN PATENT DOCUMENTS 462086 4/1978 Spain ..... 112/121.15

*Primary Examiner*—H. Hampton Hunter

*Attorney, Agent, or Firm*—Darby & Darby

[57] ABSTRACT

The present invention relates to the seaming of a spade gusset (12) into an opened seam in panti-hose by supporting the garment (10) on a carrier which comprises a head (22) onto which the panti-hose is drawn and inner support means (32, 36) displaceable within an opening (24) in the head for gripping the gusset (12) in the opening with the periphery of the gusset overlapping the periphery of the opening in the panti-hose, the gusset being stretched at least in one direction to a preselected extent. The edges of the panti-hose opening and the periphery of the gusset are mechanically seamed together while the carrier is moved relative to a seaming machine to seam the gusset to the panti-hose by a single continuous seam.

11 Claims, 6 Drawing Figures

SPADE GUSSET SEAMING APPARATUS

The present invention relates to hosiery and particularly to the seaming of spade gussets on panti-hose or similar garments.

Hitherto the seaming of so-called spade gussets to panti-hose or similar garments has generally been a manual process with only the actual seaming of the gusset being effected by machine.

The present invention seeks to provide an improved method and apparatus for automatically seaming a spade gusset to panti-hose or the like.

Accordingly the present invention provides a method of seaming a spade gussett to a garment comprising opening the garment along a preselected line while supporting the garment material on each side of said line, displacing the garment opening side edges relative to one another so as to form said opening into a preselected shape, presenting the gusset to the garment with the periphery of the gusset juxtaposed with the edges of said opening, and mechanically seaming the periphery of the gusset and the opening edges together.

The present invention also provides apparatus for seaming a spade gusset to a garment comprising means for opening the garment along a seam, a carrier for supporting the garment about said opened seam thereof and including means operable to adjust the profile of said opened seam, said carrier comprising an elongate member having a substantially gusset-shaped opening for receiving the gusset and inner support means displaceable relative to said member for gripping the gusset so as to enable the opening edges in the garment and the gusset periphery to be brought into overlapping relationship; means for mounting said gusset and presenting said gusset to said inner support means; and a seaming machine for seaming the gusset and the garment together, said carrier being displaceable relative to said machine to bring the machine into engagement with the garment and gusset to enable the gusset to be seamed to the garment by a single continuous seam.

In a preferred embodiment of the invention the elongate member of the carrier is in the form of a head onto which the garment is arranged to be drawn, suction being provided in the head to facilitate this. In this position, the garment can be opened along a seam. The inner support means comprise a number of pin or needle-like members for holding the gusset in the head opening, the needle-like members gripping the gusset along its periphery. These members are conveniently displaceable in unison so that they can be moved between a position in which they are ready to receive the gusset and a further position in which they grip the gusset against the side edge region of the head opening to retain the gusset in position. This arrangement leaves a peripheral region of the gusset projecting beyond the opening so that the edge of the opened garment seam can be aligned with the gusset edge to enable the two to be seamed together.

The present invention is further described hereinafter, by way of example, with reference to the accompanying drawings, in which.

Figure 1:
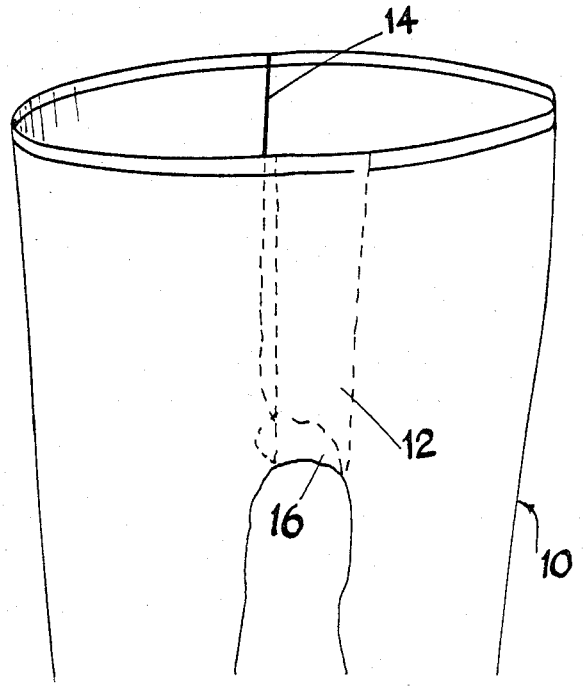
FIG. 1 is a view of a body portion of panti-hose having a spade gusset.

The panti-hose illustrated in FIG. 1 has a body 10 in which a spade gusset 12 is seamed. The panti-hose is normally manufactured without the spade gusset, the body being stitched along a seam 14 which runs from the body waistband at the back of the body to the front waistband. The seam is then opened along a preselected length from the front waistband and the gusset 12 stitched into the body to form the finished article. Hitherto, the operation has been generally manual although a sewing machine is normally used for effecting the gusset seam.

Figure 2:
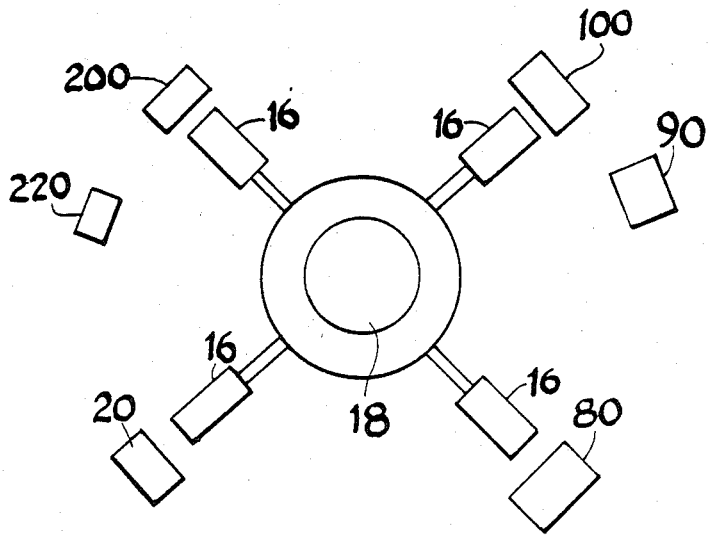
FIG. 2 is a plan view of a preferred embodiment of apparatus according to the present invention.
Figure 3:
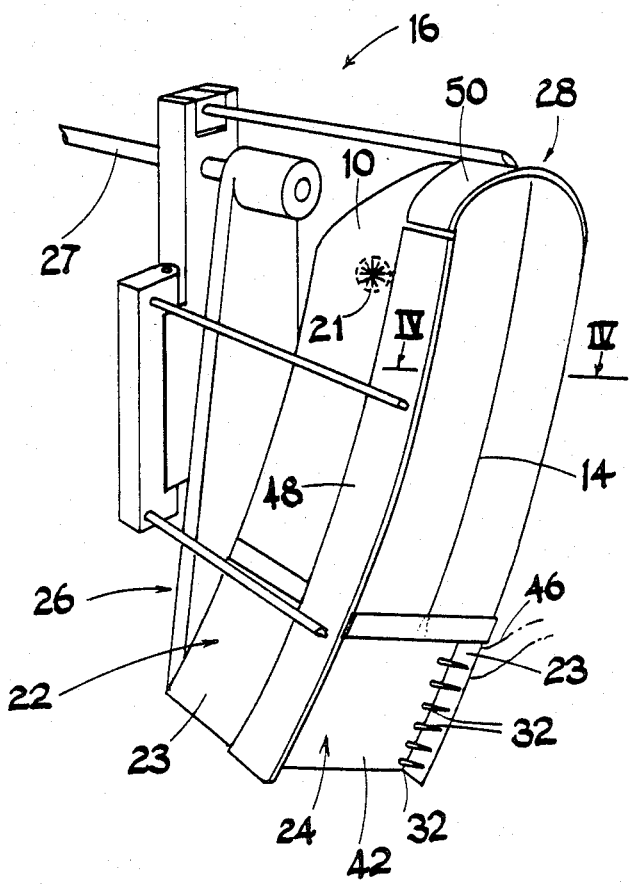
FIG. 3 is a perspective view of a carrier of the apparatus of FIG. 2.

The preferred apparatus is diagrammatically illustrated in plan in FIG. 2 and comprises a number of panti-hose carriers 16, preferably four, mounted on a central turret 18 so as to be rotatable about the turret on a substantially vertical axis. The carriers 16 are equiangularly spaced about the turret. During rotation each carrier in turn moves through a loading station 20, a seam-opening station 80, a gusset mounting station 100, a sewing station 200 and a stripping station 220. At the loading station the body of a pair of panti-hose is turned inside out and drawn onto the carrier 16 with the seam correctly aligned. The carrier is then moved through the seam-opening station 80 where the seam 14 is open from the front waistband along the required length. Movement of the carrier then continues to bring the carrier into the gusset mounting station 100. Here a previously cut spade gusset is clamped in position in a gusset mount and suitably stretched ready for the carrier. Once the carrier is in position the mount is pivoted to present the gusset to the opened seam of the panti-hose body, the gusset then being secured to the carrier with the body opening edge and gusset edge in juxtaposition. The carrier is then moved into the sewing station where the gusset is seamed to the body. Finally, the carrier is then moved to the stripping station 220 where the finished panti-hose is stripped from the carrier 16.

Looking at the carrier 16 in more detail this comprises an elongate, hollow head 22 having two planar and parallel side penels 23 spaced apart to form an elongate opening 24 facing radially outwardly of the turret. The opening is generally shaped to conform with that of the gusset. The head is supported at one end by a bracket arrangement 26 forming generally a "V" or "U" with the head, the free end of the bracket arrangement being secured to a spindle 28 which extends horizontally radially outwardly from the turret and is rotatable to pivot the head in a substantially vertical plane about the spindle axis. The two side panels 23 are joined at the free end of the head to provide a semi-circular end 28 to the opening with the spindle and head arranged relative to one another so that the spindle axis passes through the free end region of the head substantially concentric with the semi-circular opening end 28. This arrangement facilitates seaming of the gusset as is describes further below.

Figure 4:
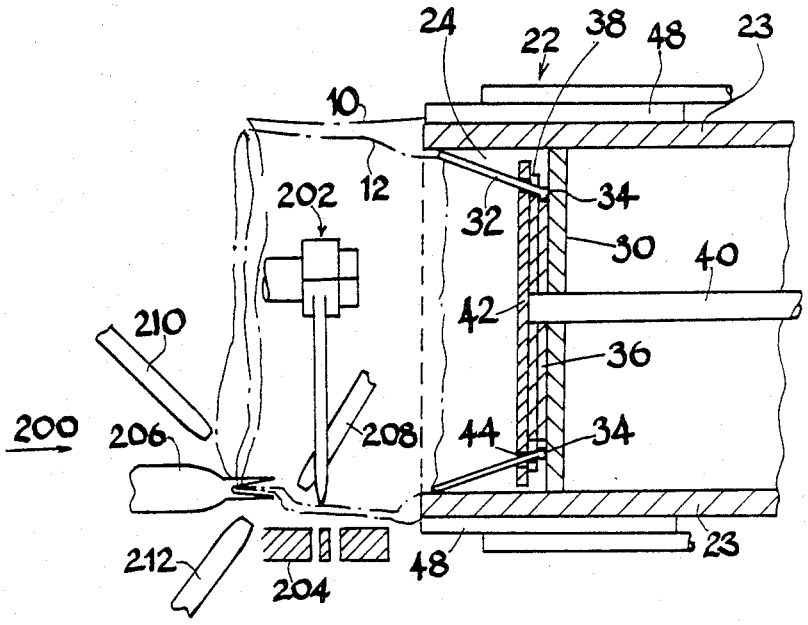
FIG. 4 is a section through the head of the carrier along the line IV—IV of FIG. 3 showing the carrier with a gusset at a sewing station of the apparatus.
Figure 5:
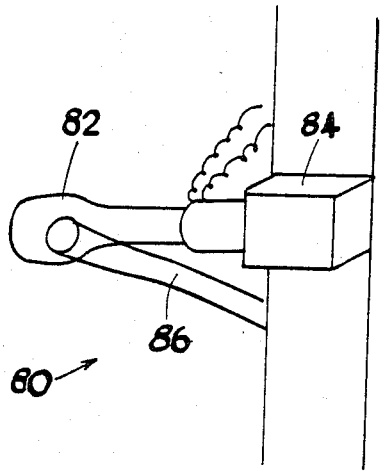
FIG. 5 is a diagrammatic view of a seam-opening station of the apparatus.

As is best seen in FIG. 4 a plate 30 is rigidly mounted in the head 22 substantially coplanar with the opening. The plate 30 pivotally supports a plurality of needles 32 each of which has a head 34 sandwiched between the plate 30 and a clamping member 36 of slightly smaller dimensions. The needles 32 are spaced about the perimeter region of the plate 30 and are freely pivotable about their heads 34 through radial slots 38 in the member 36. Each slot is wide enough to allow the needle to pivot freely but narrow enough to allow passage of the needle head. Passing through the plate 30 and member 36 is a rod 40 which is slidable axially of the head 22 and carries a further plate 42 slidable within the opening. The plate 42 has holes 44 through which the needles freely project. The holes 44 are positioned relative to the needle heads so that retraction of the plate 42 inwardly of the head pivots the needles from a position wherein their free ends are clear of the head and preferably project slightly from the opening into a position wherein the free ends of the needles abut the head side panels inwardly of the opening.

In use, the panti-hose body 10 is turned inside out and stretched over the head 22, the legs being drawn out of the way into the head behind the plate 30 through holes 21 in the side panels 23. To assist this suction is applied to the interior of the head through a suction tube 46. For this operation the head is pivoted into a substantially vertical attitude, the side panels being arranged vertically, and the body 10 is drawn over the upper portion of the head with the front portion of the seam 14 vertically aligned in the centre of the opening 24 between the side panels. A movable stop 48 or reference mark or the like arranged in or adjacent the lower portion of the opening enables an operator accurately to draw the correct length of seam over the opening.

Once the panti-hose body is correctly positioned two side clamps 48, one on each side of the head, are pivotted into position to clamp the body between the clamps and the side panels. Each clamp preferably comprises a simple plate as a jaw and each plate is first pivoted into position with an edge region overlying the opening edge of the associated side panel by a preset amount. The clamp plates are then drawn back in a direction radially inwardly preferably until the clamp plate edges are flush with the opening edges, maintaining their grip on the body material during this operation. The effect of this is to tension the body material acros the opening to facilitate the subsequent seam cutting operation.

After the side clamps are drawn back a further, top clamp 50 is pivoted into position to clamp the body against the upper portion of the head adjacent the opening 24. Again, the clamp comprises a clamp plate contoured to mate with the surface of the head upper portion but is first pivoted into a position in which its front edge is spaced back from the edge of the upper part of the opening 24 by a preset amount. The clamp plate is then slid forward, carrying the body material with it, until its edge is flush with the opening edge, this movement serving to relax tension in the body material at the upper end of the opening.

Obviously, to avoid damaging the panti-hose the clamp plates and preferably the head side panels are preferably provided with a protective layer of, for example plastics material or sponge material or the like.

The amount of movement of the clamp plates is, of course, variable and can be preselected to provide the required degree of tensioning and relaxation of the panti-hose material at the opening 24.

Once the panti-hose body is satisfactorily positioned on the head the latter is then moved toward the seam-opening station 80. During this movement the spindle 28 is turned anticlockwise through an angle of approximately 90° to turn the head onto its side with the base of the head leading movement of the head towards and through the seam-opening station 80.

The seam-opening station 80 comprises a hot-wire cutter 82 which is preferably a substantially U-shaped heated wire arranged on its side and movably supported on a supporting bracket 84 positioned outside the arcuate path of the head so that the hot-wire cutter 82 can be moved into and out of the path of the head. Before the head 22 reaches the seam-opening station 80 the hot-wire cutter 82 is moved into the path of the head, aligned with the seam 14 of the panti-hose body so that as the head moves into the station the two heated arms of the wire "U" contact the front waistband of the body on respective sides of the seam. As movement of the head continues the hot-wire cutter cuts or burns out a strip of material several millimeters wide containing the seam until, at a preselected position of the cutter along the seam, the cutter is withdrawn severing the strip of material from the body. The waste material is drawn away, for example, down a suction tube 86, and the head continues its movement towards the gusset mounting station 100. The length of the strip of material removed from the body is, of course, dependant on the speed at which the head moves through the seam-opening station and the relative position of the head and hot-wire cutter 82 when the latter is withdrawn. Movement of the cutter into the path of the head and withdrawal can be pneumatically or electromagnetically controlled and triggered by suitable means such as microswitches which sense the position of the head and trip a drive mechanism for the cutter. Alternatively, withdrawal of the cutter can be effected after a preselected time delay following its movement into the path of the head with the time delay, of course, being preselected in dependance of the speed of the head through the seam-opening station 80. Adjustment of the length of the strip of material removed from the panti-hose body can be effected by adjusting the position of the microswitches or altering the time delay or the speed of the head through the seam-opening station 80.

In order to avoid the possibility of the head fouling the hot-wire cutter 82 the lower end of the head, that is the leading end as the head moves into the seam-opening station 80, is open or cut away to provide a clear path for the hot-wire cutter up to the front waistband of the panti-hose body. In addition, the plane of the opening 24 is curved along the direction of movement of the head so that during the cutting operation the relative positions radially of the turret 18 of the hot-wire cutter and the portion of the panti-hose body stretched over the opening is substantially constant over at least the major portion of the cutting "stroke".

As will be appreciated, the cutting out of the seam 14 allows the material originally stretched over the opening to relax and during movement of the head from the seam-opening station 80 towards the gusset mounting station 100 the side clamps 48 are drawn further back along the surface of the head side panels 23 to draw the side edges of the opening cut in the panti-hose body adjacent to the side edges of the opening 24. Once this operation is complete the movable plate 42 in the head is driven forward by action of the rod 40 to pivot the needles away from the inner side wall of the head. The extended position of the plate 42 is not critical provided that the tips of the needles project through the holes 44 ready to grip the gusset when this is presented to the head. Conveniently the movable plate 42 in its extended position is located just within the opening 24.

During or subsequent to movement of the head 22 into the gusset mounting station 100 a previously cut spade gusset is presented to a gusset carrier 90 which in its simplest form is a suction head having a perforated surface to which the gusset is held by suction. Once the gusset is mounted on the gusset carrier this is moved to bring the gusset into register with a gusset clamp at the gusset mounting station 100.

Figure 6:
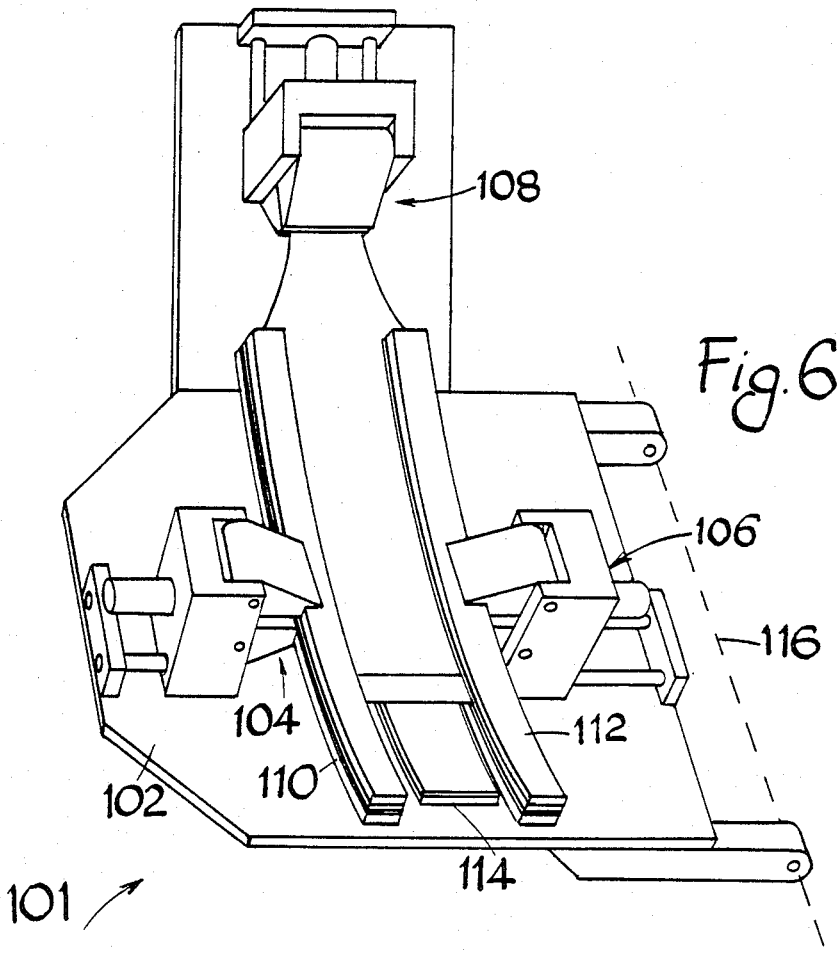
FIG. 6 is a perspective view of a gusset mounting station of the apparatus.

The gusset mounting station 100 comprises a base plate 102 on which two gusset side clamps 104 and 106 are slidably mounted so as to be slidable towards and away from one another to apply lateral stretch to the gusset. A further end clamp 108 is also slidably mounted to clamp the "lower" end of the gusset and apply a preselected amount of end stretch to the gusset. As can be seen in FIG. 6 the opposite end of the gusset is formed with a waist band portion to bridge the gap in the waist band of the cut panti-hose body 10. Each of the side clamps 104,106 has a pair of elongate jaws 110, 112 which are curved in their longitudinal direction to match the curvature of the opening 24 in the head 22. This is to facilitate presentation of the gusset to the head opening 24. The base plate 102 also mounts an elongate backing plate 114 between the side clamp jaws 110, 112, the backing plate being supported on a piston rod (not shown in the drawings) which can be actuated to drive the backing plate upwardly between the jaws 110, 112. In its retracted position the backing plate lies below the jaws clear of the gusset when the latter is clamped by the jaws. The backing plate is also curved in its longitudinal direction to conform substantially with the curvature of the opening 24.

Once the carrier head 22 is at the gusset mounting station 100 or prior thereto the gusset carrier 90 presents the gusset to the gusset clamp unit and the side and end clamps which are in their retracted and open positions move inwardly towards the gusset carrier 90 and close on the side and end edges of the gusset, the dimensions of the gusset carrier 19 being sligthly smaller than those of the gusset so that the gusset edges project freely beyond the carrier to facilitate clamping. Once the clamps are closed the gusset carrier is withdrawn and the clamps then retract a preselected amount to provide the required stretch to the gusset. Either one or both the side clamps or the end clamp or both may apply stretch to the gusset, as desired, and the degree of stretch provided by each clamp can be varied by adjusting the retraction movement of the relevant clamp or clamps. During this operation the backing plate 114 is in its retracted position.

As can be seen from the drawings the plane of the opening 24 is substantially vertical while the gusset is held in the clamp unit 101 in a generally horizontal attitude. These relative positions have been found to be the most practical although, as will be appreciated, they may be varied as desired. It will also be appreciated that although the presently described operation requires some stretching of the gusset there may be instances where stretching is not necessary and the gusset is clamped and presented to the head 22 unstretched.

Once the gusset is clamped in position and with the head 22 at the gusset mounting station 100 the gusset clamp unit 101 is pivoted about horizontal axis 116 to present the gusset to the opening 24. In this position the tips of the needles 32 engage through the gusset material adjacent the edges of the gusset, except for the waist band portion of the gusset. Here the backing plate 114 is driven forward to ensure full engagement of the gusset on the needles 32. The movable plate 42 in the head 22 is then retracted to force the tips of the needles 32 against the inner wall of the head 22 and grip the gusset, still in its stretched form, in position but leaving the gusset edge projecting out of the opening 24. The needles 32 conveniently carry shoulders or other suitable stops adjacent their tips to prevent the gusset riding down the needles. The backing plate 114 is then retracted and the clamps 104,106 and 108 opened and the gusset clamp unit 101 removed to its starting position ready to receive the next gusset. It is preferable that the clamp jaws and backing plate be provided with a protective layer of material such as foam, fabric or rubber to prevent damage to the gusset.

Once the gusset is secured in position the side clamps 48 on the carrier head 22 are moved forward towards the opening 24 until the side edges of the gusset opening in the panti-hose body overhangs the opening edges and are aligned with the gusset side edges ready for sewing. This movement of the side clamps can be effected prior to or during movement of the carrier head 22 towards the sewing station 200. Since the top clamp 50 was not previously retracted the end edge of the gusset opening is already in position in register with the end edge of the gusset.

The carrier head 22 is moved to bring the overhanging edges of the gusset 12 and body 10 at one end of the gusset waistband portion into position between a needle bar assembly 202 and throat or needle plate 204 of a seaming machine such as an overlocking or cup seaming machine. Movement of the head 22 continues to the sewing station 200 while the seaming machine seams along one pair of overhanging side edges of the gusset 12 and body 10. However, when the seaming machine reaches the trailing end of the gusset at a position aligned with the axis of the spindle 27 movement of the head 22 through the sewing station stops and the spindle then rotates the head through an angle of 180°. During this rotation seaming of the overhanging end edges of the gusset 12 and body 10 is effected, these edges extending in a substantially semi-circular path in conformity with the semi-circular end 28 of the opening 24. Once pivoting of the head 22 through 180° is completed rotation of the spindle 27 stops and movement of the head 22 through the sewing station 200 continues to effect seaming of the remaining pair of side edges of the gusset 12 and body 10.

The edges of the gusset 12 and body 10 are conveniently held in position and guided by, for example, suitable guides and air or gas jets. FIG. 4 shows three air jet nozzles 206, 208 and 210. The nozzle 206 is a suction nozzle located in front of the needle adjacent the sewing path the draw out the edges of the gusset 12 and body 10 into the required sewing position. The nozzle 206 preferably has a flattened mouth conveniently in a fan-tail shape with its side edges slotted to allow the edges of the gusset and body partially to enter the mouth and so ensure a more effecient orientation of the edges for sewing. The nozzle 208 is a pressure nozzle which is located adjacent the needle and directs a jet of air at the gusset and body edges of sufficient force to retain the edges in the required sewing position otherwise once passed the suction nozzle 206 the edges could spring back out of the needle path as a result of the natural resilience of the material. A number of nozzles 206 and 208 may be provided. The nozzle 210 located above the nozzle 206 serves the same purpose as the nozzle 206 during the seaming of the end edges of the gusset and body. Because of the positioning of the nozzle 206 to draw out the side edges of the gusset 12 and body 10 its effectiveness in drawing out the end edges is reduced. The addition of the nozzle 210 compensates for this reduction in efficiency.

Cutting means such as knives, not shown, are provided to trim the edges of the gusset 12 and body 10 prior to sewing and a further suction nozzle 212 draws off the trimmed waste.

Once the gusset has been stitched to the body and the head 22 has moved out of the sewing station the movable plate 42 is moved forward to release the gusset from the needles and the panti-hose is drawn from the head at the following stripping station 220. This can comprise a suction apparatus for sucking the panti-hose off the head 22 or a mechanical finger which is moved across the head 22 to engage the panti-hose body and draw it off the head.

While the preferred embodiment of the present invention has been described in relation to panti-hose it will be apparent to those skilled in the art that the present invention may also be applied to any suitable garment requiring the addition of a spade-type gusset.

During movement of the carriers around the turret the individual movements of these are effected by cams in the turret while the various movements necessary at the stations, for example by the hot-wire cutter and gusset are conveniently effected pneumatically.

I claim:

1. Apparatus for automatically seaming a spade gusset to a garment comprising a carrier for supporting the garment about a seam thereof; and means for opening the garment along said seam, said carrier comprising an elongate member having a substantially gusset-shaped opening for receiving the gusset, means operable to adjust the profile of an opened seam, and inner support means mounted internally of said member and displaceable relative to said member for gripping the gusset so as to enable the opening in the garment and the gusset periphery to be brought into overlapping relationship; a gusset mounting station comprising means for mounting said gusset and presenting said gusset to said inner support means; a sewing station comprising a seaming machine for seaming the gusset and the garment together, said carrier being displaceable relative to said machine to bring the machine into engagement with the garment and gusset to enable the gusset to be seamed to the garment by a single continuous seam.

2. Apparatus as claimed in claim 1 wherein the elongate member comprises a substantially tubular member over which the garment is arranged to be drawn.

3. Apparatus as claimed in claim 2 wherein said inner support means comprises a plurality of members displaceable between a first position wherein said members are arranged to penetrate the gusset material and a second position wherein said members retain said gusset in its stretched condition with its periphery adjacent the periphery of said garment opening.

4. Apparatus as claimed in claim 3 wherein each said member is a pivotable needle and in said second position said members grip the gusset against the side walls of the elongate member forming said gusset-shaped opening.

5. Apparatus as claimed in claim 1 wherein said means operable to adjust the profile of said opened seam comprises a plurality of clamping members arranged to clamp the garment adjacent its opened seam on said elongate member and wherein the position of said clamping members is adjustable to adjust the position of the clamped portions of the garment relative to the member opening.

6. Apparatus as claimed in claim 1 wherein said mounting means comprises a plurality of clamping members for gripping edges of a gusset presented to the mounting means; and the position of at least one of said clamping means is adjustable for stretching the gusset a preselected amount in a preset direction.

7. Apparatus as claimed in claim 6 wherein a respective clamping means is provided for gripping each of two longitudinal side edges of the gusset and the end edge of the gusset arranged to form the lower end edge of the gusset when the gusset is seamed into the garment.

8. Apparatus as claimed in claim 7 wherein said mounting means includes a backing member movable between a retracted position wherein said member is clear of a gusset in the mounting means and an extended position for urging said gusset into engagement with said inner support means of said carrier.

9. Apparatus as claimed in claim 1 wherein said carrier is rotatable about an axis perpendicular to the plane of the gusset opening in said elongate member for enabling relative movement of said carrier and said seaming machine for seaming the lower end of said gusset to said garment.

10. Apparatus as claimed in claim 1 wherein said carrier is arranged to support said gusset in a plane whose line of curvature longitudinally of the gusset is convex.

11. An apparatus for automatically applying a spade gusset to a garment comprising a carousel unit having at least one carrier for supporting the garment in a predetermined position thereon, the carrier being supported for movement about a substantially vertical axis of the unit successively through a cutting station for providing on opening in said garment for receiving the gusset, a gusset mounting station for presenting the gusset to the garment opening and a sewing station for seaming the gusset into the garment opening; and wherein the carrier comprises an elongate member having a substantially gusset-shaped area for receiving the gusset and inner support means displaceable relative to said member for gripping the gusset so as to enable the garment opening edges and the gusset periphery to be brought into overlapping relationship.

* * * * *